US010731093B2

(12) United States Patent
Ouni et al.

(10) Patent No.: US 10,731,093 B2
(45) Date of Patent: Aug. 4, 2020

(54) WASH OIL FOR USE AS AN ANTIFOULING AGENT IN GAS COMPRESSORS

(71) Applicant: Borealis AG, Vienna (AT)

(72) Inventors: Tuomas Ouni, Espoo (FI); Rebeca Reguillo Carmona, Linz (AT); René Dicke, Leonding (AT); Ana Lilia Mota Salinas, Linz (AT)

(73) Assignee: Borealis AG, Vienna (AT)

( * ) Notice: Subject to any disclaimer, the term of this patent is extended or adjusted under 35 U.S.C. 154(b) by 311 days.

(21) Appl. No.: 15/529,833

(22) PCT Filed: Nov. 23, 2015

(86) PCT No.: PCT/EP2015/077334
§ 371 (c)(1),
(2) Date: May 25, 2017

(87) PCT Pub. No.: WO2016/083290
PCT Pub. Date: Jun. 2, 2016

(65) Prior Publication Data

US 2017/0260464 A1 Sep. 14, 2017

(30) Foreign Application Priority Data

Nov. 26, 2014 (EP) ..... 14194916

(51) Int. Cl.

| | |
|---|---|
| ***C11D 3/20*** | (2006.01) |
| ***C11D 3/37*** | (2006.01) |
| ***B08B 3/08*** | (2006.01) |
| ***C10G 75/04*** | (2006.01) |
| ***C11D 7/50*** | (2006.01) |
| ***C23G 5/024*** | (2006.01) |
| ***C11D 3/00*** | (2006.01) |
| ***C11D 3/18*** | (2006.01) |
| ***C11D 7/24*** | (2006.01) |
| ***C11D 7/26*** | (2006.01) |

(52) U.S. Cl.
CPC ..... *C10G 75/04* (2013.01); *B08B 3/08* (2013.01); *C11D 3/0073* (2013.01); *C11D 3/187* (2013.01); *C11D 3/2075* (2013.01); *C11D 7/247* (2013.01); *C11D 7/265* (2013.01); *C11D 7/5027* (2013.01); *C23G 5/024* (2013.01)

(58) Field of Classification Search
CPC ..... C11D 3/0073; C11D 3/187; C11D 3/2075; C11D 7/247; C11D 7/265; B08B 3/08
USPC ..... 510/183, 184, 187, 254, 255, 258, 401, 510/477, 488; 134/20, 32, 34, 39, 40
See application file for complete search history.

(56) References Cited

U.S. PATENT DOCUMENTS

| | | | | |
|---|---|---|---|---|
| 2,443,217 A | | 6/1948 | Amos et al. | |
| 2,614,904 A | | 10/1952 | Royer et al. | |
| 2,773,109 A | | 12/1956 | Lien et al. | |
| 2,855,430 A | | 10/1958 | Ralph et al. | |
| 4,329,529 A | | 5/1982 | Nambu | |
| 4,498,980 A | | 2/1985 | Forte | |
| 4,571,295 A | | 2/1986 | Forte | |
| 4,604,439 A | | 8/1986 | Colvin et al. | |
| 4,992,108 A | * | 2/1991 | Ward | C11D 3/43 134/38 |
| 5,285,006 A | | 2/1994 | Poindexter et al. | |
| 5,677,388 A | | 10/1997 | Koster et al. | |

(Continued)

FOREIGN PATENT DOCUMENTS

| | | |
|---|---|---|
| AU | 2802984 A | 1/1985 |
| CN | 1260379 A | 7/2000 |

(Continued)

OTHER PUBLICATIONS

Osokogwu et al., "Evaluation of Corrosion Inhibitors Effectiveness in Oilfield Production Operations", International Journal of Scientific & Technology Research, 2012, pp. 19-23, vol. 1:4.
Papavinasam, "Corrosion Inhibitors", Uhlig's Corrosion Handbook, Second Edition, Chapter 59, 2000, pp. 1089-1105, John Wiley & Sons, Inc., Ottawa, Ontario, Canada.
Uyigue, "Enhancing the Wash Oil Antifouling Action in a Cracked Gas Compression (CGC) System", Global Journal of Pure and Applied Sciences, 2005, pp. 99-105, vol. 11:1.
"ADVASOL® HAD (Heavy Aromatic Distillate) Safety Data Sheet", Monument Chemical, Aug. 19, 2016, 17 pages, vol. 77, No. 58.

(Continued)

*Primary Examiner* — Gregory R Delcotto
(74) *Attorney, Agent, or Firm* — The Webb Law Firm

(57) ABSTRACT

The present invention relates to wash oil for use as an antifouling agent in gas compressors, in particular in cracked gas compressors, including at least one compound according to formulae (II)

II with the moieties $R^2$ and $R^3$ are selected from a group of linear or branched $C_1$-$C_{20}$-alkyl, $C_3$-$C_{10}$-cycloalkyl and linear or branched $C_1$-$C_{10}$-alkyl substituted $C_3$-$C_{10}$-cycloalkyl and $C_6$-$C_{12}$ aryl and $C_1$-$C_{10}$-alkyl substituted $C_6$-$C_{12}$ aryl. The moieties can be interrupted by oxygen or nitrogen. The moieties can be functionalised with hydroxyl groups or amino groups. The moieties can be the same or different. The invention relates also to the use of such wash oil as antifouling agent.

17 Claims, 6 Drawing Sheets

(56) References Cited

U.S. PATENT DOCUMENTS

| | | | | |
|---|---|---|---|---|
| 6,344,560 | B1 | 2/2002 | Geelan et al. | |
| 6,350,921 | B1 | 2/2002 | Durairaj et al. | |
| 6,365,782 | B1 | 4/2002 | Nakamura et al. | |
| 6,797,677 | B2 | 9/2004 | Esche, Jr. et al. | |
| 7,758,768 | B2 | 7/2010 | Machado | |
| 8,658,583 | B2 * | 2/2014 | Lee | C11D 1/22 510/175 |
| 8,691,994 | B2 | 4/2014 | Tong | |
| 2002/0049132 | A1 | 4/2002 | Jan et al. | |
| 2004/0079392 | A1 | 4/2004 | Kuechler et al. | |
| 2007/0257233 | A1 * | 11/2007 | Akutsu | C11D 1/72 252/364 |
| 2008/0039355 | A1 * | 2/2008 | Katano | C11D 3/43 510/407 |
| 2008/0234157 | A1 | 9/2008 | Yoon et al. | |
| 2010/0136237 | A1 * | 6/2010 | Kumazawa | C11D 7/5027 427/331 |
| 2010/0279910 | A1 * | 11/2010 | Lee | C11D 1/22 510/176 |
| 2011/0245558 | A1 | 10/2011 | Schmidt | |
| 2011/0247660 | A1 * | 10/2011 | Lee | G03F 7/425 134/26 |
| 2012/0277133 | A1 | 11/2012 | DiBiase et al. | |
| 2013/0225462 | A1 | 8/2013 | Di Biase et al. | |
| 2014/0121143 | A1 | 5/2014 | Patil et al. | |
| 2014/0162915 | A1 | 6/2014 | Hatfield | |
| 2016/0355415 | A1 * | 12/2016 | Koehler | C02F 1/441 |

FOREIGN PATENT DOCUMENTS

| | | | |
|---|---|---|---|
| CN | 1699311 | A | 11/2005 |
| CN | 1733623 | A | 2/2006 |
| CN | 102071061 | A | 5/2011 |
| CN | 103351888 | A | 10/2013 |
| CN | 103725335 | A | 4/2014 |
| CN | 103756010 | A | 4/2014 |
| DE | 2937521 | A1 | 3/1980 |
| DE | 102008061611 | A1 | 6/2009 |
| EP | 0248954 | A1 | 12/1987 |
| EP | 0576010 | A1 | 12/1993 |
| EP | 1369469 | A1 | 5/2003 |
| GB | 889297 | | 2/1962 |
| JP | 56144740 | A | 11/1981 |
| JP | S6054327 | A | 3/1985 |
| JP | 20012611 | A | 1/2001 |
| JP | 20012612 | A | 1/2001 |
| JP | 200110998 | A | 1/2001 |
| JP | 200919578 | A | 1/2009 |
| KR | 100304820 | B1 | 9/2001 |
| KR | 1020120134675 | A | 12/2012 |
| RO | 66123 | A2 | 11/1981 |
| RO | 81748 | | 5/1983 |
| RO | 92467 | A2 | 9/1987 |
| RU | 2491326 | C2 | 8/2013 |
| SU | 31283 | A1 | 7/1933 |
| WO | 9802403 | A1 | 1/1998 |
| WO | 9810033 | A1 | 3/1998 |
| WO | 9943637 | A1 | 9/1999 |
| WO | 0147844 | A1 | 7/2001 |
| WO | 0183567 | A2 | 11/2001 |
| WO | 02088055 | A1 | 11/2002 |
| WO | 2006078123 | A1 | 7/2006 |
| WO | 2007003024 | A1 | 1/2007 |
| WO | 2012106410 | A2 | 8/2012 |

OTHER PUBLICATIONS

"Aromatic 100 Safety Data Sheet", Megaloid Laboratories Limited, published May 2004, Revised May 2007, 2010, and 2013, 4 pages.
"Aromatic 150 Safety Data Sheet", Megaloid Laboratories Limited, May 2013, 4 pages.
"Atosol 150 Material Safety Data Sheet", Total, May 27, 2013, 8 pages.
"NALCO® EC3144A Safety Data Sheet", NALCO, 2010, 12 pages.
"RB Solv HAD Material Safety Data Sheet", RB Products Inc, Jul. 2011, 7 pages.
"RB Products Internet archive capture", RB Products Inc, 2014, 2 pages.
"Solvent naphtha (petroleum), heavy arom.", European Chemicals Agency, 2001.
United States Defensive Publication No. 741203, Jun. 28, 1968, 6 pages.
Bangerter et al., "Cracked Gas Compression", Oil Gas European Magazine, 1993, pp. 12-17, vol. 19, No. 4.
Barnard, "Centrifugal compressors fouling—understanding, mitigating, and cleaning", IMechE Conference Transactions, Compressors and their Systems, 2001, p. 241-250, London, UK.
Chumakov, "The Novel Use of Nitroxide Antioxidants as Free Radical Scavengers in Ultra-High Molecular Weight Polyethylene (UHMWPE) for Total Joint Replacements", Dissertation University of Maryland, 2010, 211 pages.
De Haan et al., "Overview of Cracked Gas Compressor Fouling: Theories and Practices", Ethylene Producers' Conference, 2001, 46 pages, vol. 13, No. 76B.
Harperscheid et al., "Lubricants, 4. Lubricants for Internal Combustion Engines", Ullmann's Encyclopedia of Industrial Chemistry, 2012, pp. 461-478, vol. 21.
Jianmin, Ethylene Industry, 2011, pp. 45-48, vol. 23, No. 4.
Martin, "Reduce olefin plant fouling", Hydrogen Processing International Edition, 1988, pp. 63-67, vol. 67, No. 11.
Matthews et al., "Case Study: Ethylene Plant Experience with Oil & Water Injection to Cracked Gas Compressors", 131h Ethylene Producers Conference, American Institute of Chemical Engineers, 2001, pp. 168-189.
Meher-Homji et al., "Gas Turbine Axial Compressor Fouling and Washing", Proceedings of the Thirty-Third Turbomachinery Symposium, 2004, pp. 163-191.
Shang et al., "Application of new type polymerization inhibitor EC3144A in ethylene production", Heilongjiang Petrochemical Technology, Chinese Knowledge Infrastructure Guide, 2000, 3 pages, vol. 11.
Shutov et al., "Destruction of sulfonol in its aqueous solutions by contact glow discharge treatment: 2. Mechanisms and kinetic simulation", High Energy Chemistry, 2013, pp. 258-261, vol. 47, No. 5.
Snider et al., "Ethylene Plant Cracked Gas Compressor Fouling", Nalco Company, 2006, 42 pages.
Taylor, "Internal-Combustion Engine in Theory and Practice", Combustion, Fuels, Materials, Design (2nd edition, revised), 1985, pp. 86-118, vol. 2, Ch. 3.
Tsutsumi, Journal—Fuel Society Japan, 1956, pp. 32-40, vol. 35.
He et al., "Development and Application of Nitroxyl Free Radical Polymerization Inhibitor", Chemical Technology Market, 2006, pp. 32-37, vol. 29, No. 4.
Li, "Technical Measures to Inhibit Coking of Cracking Gas Compressor", Journal of Chemical Industry & Engineering, 2010, pp. 46-52, vol. 31, No. 4.
Yang, "Technical Points of Long Period Operation for Ethylene Plant", Sino-Global Energy, 2007, pp. 76-86, vol. 12.

* cited by examiner

| | Initial Bp | Final Bp |
|---|---|---|
| Internal wash oil | 64 | 117 |
| DIPB | 195 | 208 |
| Commercial wash oil | 246 | 299 |
| Recommended Bp | 200 | 200 |

WASH OIL FOR USE AS AN ANTIFOULING AGENT IN GAS COMPRESSORS

CROSS-REFERENCE TO RELATED APPLICATIONS

This application is the United States national phase of International Application No. PCT/EP2015/077334 filed Nov. 23, 2015, and claims priority to European Patent Application No. 14194916.4 filed Nov. 26, 2014, the disclosures of which are hereby incorporated in their entirety by reference.

BACKGROUND OF THE INVENTION

Field of the Invention

The invention relates to a wash oil for use as an antifouling agent in gas compressors and the use of such a wash oil.

Description of Related Art

Cracked gas compression systems are multi-stage systems and comprise multiple gas compressors provided with interstage coolers and afterstage coolers at the compression discharge. The coolers are typically heat exchangers that remove the heat of the compression from the gas feed and reduces its temperature to approximately the temperature at the compression intake. Another use of coolers is the reduction of the actual volume of gas flowing to the high pressure cylinders while the separator after the intercooler is installed to remove the condensed liquid.

Cracked gas compression systems such as in ethylene plants are prone to fouling. Foulants may be found deposited in the compressor, aftercoolers or both, in particular on the compressor's casings, bearings, blades, seals, rotors and discharge lines. Other locations areas of fouling may include interstage cooler shells and tubes, cooling water sides and knockout drum plates and trays (Global Journal of Pure and Applied Science, Volume 11, 2005, pages 99 to 105).

Fouling of the cracked gas compressor system is mostly caused by polymerization and condensation reactions involving materials present in the cracked gas that polymerize and deposit on the internal surfaces of the compressor and aftercoolers. Such polymeric fouling affects the cracked gas compression system in a number of ways, such as reducing the compressor's efficiency by increasing the energy consumption and by causing compressor vibrations which may lead to reduction in throughput and run length. Furthermore, fouling deposits found in the interstage cooler tubes and shells reduce heat transfer by raising the inlet temperature of the next stage. Also, pressure drop across the cooler may increase as well by reducing the inlet pressure and efficiency of the next stage.

As mentioned, fouling comprises polymerization and condensation deposits which result from the reaction of compounds such as butadiene and styrene or other unsaturated compounds present in the cracked gas. It is being suggested that the reactions primarily responsible for fouling are free radical polymerization and diels-alder condensation reactions.

The radical polymerization reaction is caused by heat and enhanced by the presence of peroxides (see scheme 1).

Thermal Initiation:

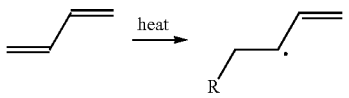

-continued

Propagation:

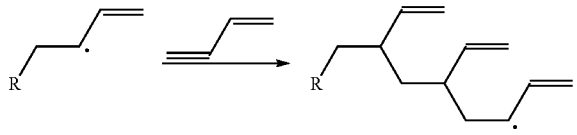

Hydroperoxide Decomposition

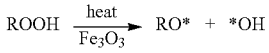

Initiation Butadiene Polymer

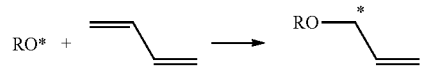

Propagation

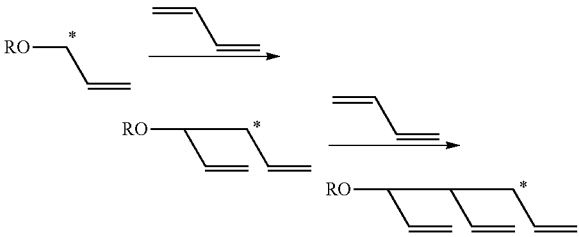

Diels-alder condensation reactions also contribute to the problem which results in the formation of heavy material that condenses on the inner surfaces of the compressor and gradually dehydrogenates. Such condensation products are potential source of hard coke-like material that can damage seals and other parts of the internals of the compressor (see scheme 2).

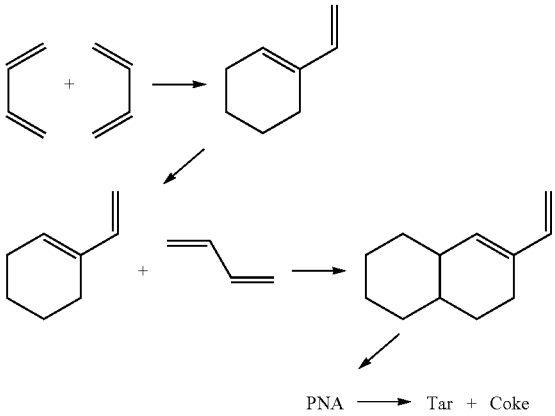

In the past, several methods have been applied to control the process of gas compressor fouling in the ethylene industry. The commonly applied methods for reducing or inhibiting fouling include the use of appropriate coatings, wash oil, water injections, anti-foulants and other design and operating considerations.

Compressor coatings are used to reduce corrosion and foulant deposition in process gas compressors and are typically applied to the diaphragms and rotor assemblies during maintenance downtime. By providing such coatings the surface characteristics of the compressor are changed such that an adhesion of the polymer to the surface is prevented.

Another approach is the addition of so-called anti-foulants which reduce the impact of fouling in various ways. Antifoulants are chemical species to prevent reactions or terminate polymer chain formation. In particular, inhibitors are used to reduce the free radical polymerization rates and metal deactivators can be applied to prevent catalysis of hydro peroxide decomposition. It is also possible to add dispersants as anti-foulants to reduce polymer deposition.

Another common approach for inhibiting fouling of cracked gas compressors is the addition of water in order to lower the gas discharge temperature and the gas volume. Water vaporizes in the compressor stage and by doing so it absorbs heat of the compression. The decrease in temperature reduces the fouling rates and is a key component of fouling control. The obvious drawback when adding water to the compressor is the potential for corrosion and erosion.

An even further and often applied strategy for reducing fouling is to dissolve the polymer deposits after its formation. This can be done by adding a solvent (or also called wash oil) that is capable of removing the deposit and is added directly to the compressor. The basic properties of a suitable wash oil are a high aromatic content and a high boiling point. Suitable wash oils should be furthermore free of fouling precursors and suspended solids.

The aromatic content of a promising wash oil is in the range of 60 wt % and higher, preferably above 80 wt %. The higher the aromatic content of a wash oil the higher its potential to dissolve the polymer deposits.

Wash oils with a high boiling point will ensure that the wash oil remains liquid allowing it to dissolve and remove polymer from the metal surfaces and minimize the deposition of solids. Initial boiling points of greater than 200° C. are recommended.

Furthermore, the wash oil should be low in monomer content and free of polymer and solids itself in order not to add to the fouling problem. While high in aromatic content, the wash oil should be essentially free of styrene and diene compounds. Since the wash oil may at least partially evaporate in the compressor, it should thus also be free or almost free of any suspended solid.

There are many different wash oils on the market, though $C9^+$material typically available as a recycle from the gasoline hydrotreator (GHU) it is preferably used in naphtha cracking plants. Said material has low diene content and the styrene content is typically about 0.3 wt % or less. The $C9^+$stream contains 60 to 80% aromatics and has a boiling end point of about 230 to 260° C.

Other wash oils offered by manufacturers are pyrolysis gasoline derivatives or naphthalene depleted fractions of aromatic streams from oil refineries.

However, the presently available wash oils are of a rather high price adding to the overall costs of the gas cracking process.

It was therefore an object of the present invention to provide a wash oil for use as an anti-fouling agent in gas compressors which combines the requirements for suitable wash oil at a reasonable price.

SUMMARY OF THE INVENTION

Accordingly, a wash oil for use as an anti-fouling agent in gas compressors, in particular in cracked gas compressors, is provided which comprises at least one compound according to formulae II

II

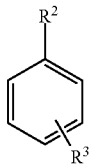

wherein the moieties $R^2$ and $R^3$ are selected from a group comprising linear or branched $C_1$-$C_{20}$-alkyl, $C_3$-$C_{10}$-cycloalkyl and linear or branched $C_1$-$C_{10}$-alkyl substituted $C_3$-$C_{10}$-cycloalkyl and $C_6$-$C_{12}$ aryl and $C_1$-$C_{10}$-alkyl substituted $C_6$-$C_{12}$ aryl and wherein said moieties can be interrupted by oxygen or nitrogen and wherein said moieties can be functionalised with hydroxyl groups or amino groups and wherein said moieties can be the same or different, and at least one additive selected from a group comprising polymerization inhibitor, antioxidant, metal deactivator, metal scavenger, corrosion inhibitor and pH-control additive.

In a preferred embodiment a wash oil is provided which comprises a mixture of at least two, preferably at least three compounds according to formulae I, II and III, respectively.

Thus, the mixture used as a wash oil comprises either one compound of formulae II or may comprise at least two, preferably at least three compounds, in particular at least one of each of the three compounds of the following formulae I, II and III

I

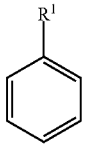

II

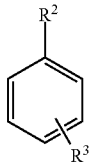

III

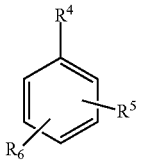

wherein the moieties $R^1$, $R^2$, $R^3$, $R^4$, $R^5$ and $R^6$ are selected from a group comprising linear or branched $C_1$-$C_{20}$-alkyl, $C_3$-$C_{10}$-cycloalkyl and linear or branched $C_1$-$C_{10}$-alkyl substituted $C_3$-$C_{10}$-cycloalkyl and $C_6$-$C_{12}$ aryl and $C_1$-$C_{10}$-alkyl substituted $C_6$-$C_{12}$ aryl and wherein said moieties can be interrupted by oxygen or nitrogen and wherein said moieties can be functionalised with hydroxyl groups or amino groups and wherein said moieties can be the same or different.

It has been surprisingly found that a mixture comprising at least one of each of the above mentioned substituted benzene compounds and at least one of the additive fulfils the requirements for a suitable wash oil. For example, the provision of the present wash oil combining at least one of the compounds of formulae I, II and III (or the mixture thereof) with at least one of the additives with anti-fouling effect provides important benefits in maintaining and improving the efficiency of compressors. While anyone of the antifoulants alone will act in the fouling mechanism, slowing significantly down the formation of solid residues in the equipment, they are however not able to avoid completely the fouling formation. This creates a slow decrease of the compressor efficiency after a certain period of time due to the accumulation of solids. It was surprisingly found that the efficiency of the compressor was maintained at high levels for longer periods of time when injecting the present wash oil mixture of anyone of the additives with antifoulant effect and the compound of formulae I, II, III.

The beneficial effect of the present wash oil mixture may be explained by considering that the aromatic compound wash oil will remain in liquid state in the compressor. As the aromatic compound wash oil acts as a carrier for the antifoulant additive, this will facilitate the reaction of the antifoulant in liquid phase with the fouling precursors that will tend to migrate to the liquid phase as well. In addition, due to the unique solubility characteristic of the aromatic compound wash oil the residues that are formed despite the action of the antifoulants will be solubilised and also the products resulting from the reaction of the antifoulants with the reactive monomers, avoiding their deposition in the equipment and carrying them out of the system. The synergetic effect of the combination of wash oil with antifoulant additives is therefore translated into a more stable compressor operation at high efficiency rate for longer periods of time.

In a preferred embodiment the present wash oil comprises 0 to 10 mass %, preferably 1 to 7 mass %, most preferably 2 to 5 mass % of a mono-substituted benzene according to formula I; 60 to 100 mass %, preferably 70 to 97 mass %, most preferably 80 to 90 mass % of a di-substituted benzene according to formula II; and 0 to 5 mass %, preferably 1 to 3 mass %, most preferably 1.5 to 2 mass % of a tri-substituted benzene according to formula III.

In a further variant of the present wash oil the mixture comprises at least three of the compounds selected from a group comprising compounds according to formulae I, IIa-b and IIIa-c with the following structures

I

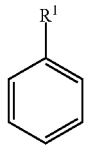

IIa

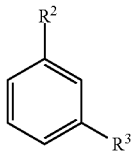

IIb

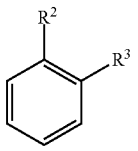

-continued

IIc

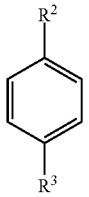

IIIa

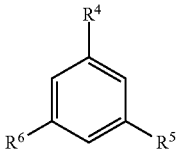

IIIb

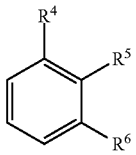

IIIc

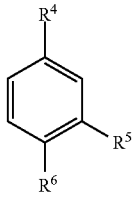

It is in particular preferred if the wash oil comprises mono-substituted benzene, at least one isomer of di-substituted benzene according to one of the formulae IIa-IIc and at least one isomer of tri-substituted benzene according to one of the formulae IIIa-IIIc.

It is in particular preferred if the wash oil comprises monoalkylbenzene, at least one isomer of dialkylbenzene according to one of the formulae IIa-IIc and at least one isomer of trialkylbenzene according to one of the formulae IIIa-IIIc.

In a mostly preferred embodiment the wash oil mixture comprises mono-substituted benzene, ortho-, meta-, para-isomers of di-substituted benzene (i.e. 1,2; 1,3; 1,4 di-substituted benzene) and the three isomers of tri-substituted benzene (i.e. 1,3,5; 1,2,3; 1,3,4 tri-substituted benzene).

It is preferred if the moieties $R^1$, $R^2$, $R^3$, $R^4$, $R^5$ and $R^6$ of the above compounds according to formulae I, II and III are selected from a group comprising $C_1$-$C_{12}$-alkyl and $C_3$-$C_7$-cycloalkyl. It is in particular preferred if the moieties $R^1$, $R^2$, $R^3$, $R^4$, $R^5$ and $R^6$ are selected from the group comprising methyl, ethyl, propyl, isopropyl, butyl or iso-butyl. Thus, the term "$C_1$-$C_{12}$-alkyl" relates to moieties like methyl, ethyl, propyl, isopropyl, butyl or iso-butyl, s-butyl, t-butyl, amyl, t-amyl, hexyl, heptyl, octyl, nonyl, decyl, undecyl, dodecyl, and alike. The most preferred alkyl moieties are ethyl, propyl, iso-propyl.

In case the moieties $R^1$, $R^2$, $R^3$, $R^4$, $R^5$ and $R^6$ are interrupted by oxygen or nitrogen said moieties are selected from a group comprising $—(CH_2)_n—NR^7R^8$, $—(CH_2)_n—N(R^7)—(CH_2)_m—R^7$, $—(CH_2)_n—O—R^7$, $—(CH_2)_n—O—(CH_2)_m—R^7$, wherein $R_7$, $R_8$ can be H, $C_1$-$C_{12}$ alkyl, $C_3$-$C_7$ cycloalkyl, $C_6$-$C_2$ aryl, wherein $R_7$, $R_8$ can be the same or different, and wherein n,m=0-10, in particular 1-5. It is in particular preferred if in this case the moieties $R^1$, $R^2$, $R^3$, $R^4$, $R^5$ and $R^6$ are selected from the group comprising oxyethyl, dioxyethyl, aminoethyl.

The term "$C_3$-$C_7$-cycloalkyl" comprises preferably groups like cyclopropyl, cyclobutyl, cyclopentyl, cyclohexyl and cycloheptyl, which can be also interrupted by oxygen or nitrogen.

The term "aryl" relates to aromatic hydrocarbons, in particular to benzyl or naphthyl. Said aryl groups may be connected to the benzene ring of the compounds according to one of the formulae I-III either directly, i.e. forming for example diphenyl compounds, or may be connected via an alkylen (—$C_nH_{2n}$) bridge (n=1-6), such as a methylen (—$CH_2$—), ethylen ($C_2H_4$—) or propylen (—$C_3H_6$—) bridge, which can be also interrupted by oxygen or nitrogen. As mentioned above the aryl groups may be also further substituted by one or more $C_1$-$C_{10}$-alkyl moieties, in particular by methyl, ethyl, propyl or isopropyl.

In another variant the wash oil comprises additional heavier aromatic carbons (higher boiling point aromatics), such as substituted or non-substituted C10 to C14 aromatic hydrocarbons. Examples of said heavier aromatic compounds are substituted or non-substituted biphenyl derivatives, such as alkylated or non-alkylated biphenyl derivatives. However, it is preferred to keep the amount of heavier aromatic hydrocarbons as low as possible in order to minimize any suspended solids in the wash oil.

In another preferred embodiment, the present wash oil has a boiling range at temperatures between 150° C. and 300° C., preferably between 170° C. and 250° C., most preferably between 190° C. and 220° C.

It is also preferred if the mixture used as a wash oil is free or almost free of non-aromatic compounds, in particular free of non-aromatic compounds such as C1-C8 alkanes, C5-C8-cycloalkenes, C2-C8 alkenes and/or C3-C8 alkynes. It is also preferred if the mixture presently used as wash oil is free or almost free of any solids or other residues.

In a preferred embodiment the ratio of the at least one compound according to formulae (II) or the mixture of the at least two, preferably at least three compounds according to formulae (I), (II) and (III) and the at least one additive selected from a group comprising polymerization inhibitor, antioxidant, metal deactivator (or metal scavenger) corrosion inhibitor and pH-control additive is between 1000/1 and 10/1, preferably 500/1 and 50/1, most preferably 100/1.

The further compounds added to the wash oil, are chosen depending on the nature of the fouling deposits formed in the compressor. As mentioned these can include polymerization inhibitors, antioxidants, dispersants, metal deactivators, metal scavengers and corrosion inhibitors and pH control additives.

Polymerization inhibitor added follow essentially two basic reaction mechanisms. Either according to a first mechanism the propagation radical is terminated by abstracting a hydrogen atom from the inhibitor molecule, and forms a less reactive inhibitor radical I., or according to a second mechanism the propagation radical is quenched via an addition reaction to form a relatively stable species RIH. The radicals formed in these mechanisms (i.e. I. and RIH.) are not reactive thus can neither add to double bonds nor abstract hydrogen atoms. Consequently they usually form non-radical products by combining with another radical or dismutation. Different types of polymerization inhibitors follow different inhibition mechanisms. Hydrogen abstraction is typical for phenol- and amine-type inhibitors, while addition mechanism is common to nitroxide and quinone inhibitors. Typical inhibitors or radical scavengers used are for example 2,6-di-t-butyl-4-methylphenol or alkylated diphenylamines.

Many polymerization inhibitors (e.g. phenols and derivatives) work best in the presence of oxygen because they intercept peroxyl radicals and decelerate oxygen consumption while stopping chain propagation. These kinds of inhibitors quench peroxyl radicals and alkyl radicals via the same hydrogen abstraction mechanism which leads to formation of a phenoxyl radical. The phenoxyl radical is less reactive because it is stabilized by resonance effect. As hydroperoxide decomposers for example dialkyl polysulfides, dialkyl hydrogen phosphites, alkylphenols, zinc dialkyl dithiophosphate or methylene coupled dithiocarbamate may be used.

It is preferred if the at least one polymerization inhibitor is selected from the group of aromatic and heteroaromatic compounds or the hydrogenated variants thereof, in particular phenol and N-aryl compounds and their hydrogenated counterparts. The most preferred polymerization inhibitors include 2,6-di-t-butyl-4-methylphenol, alkylated diphenylamines or piperidin derivatives, such as 4-Hydroxy-2,2,6,6-tetramethylpiperidin-N-oxyl.

Either a non-surface active polymer or a surface-active substance is added as a dispersant to improve the separation of fouling oligomers being formed and therefore avoiding the formation of higher polymers. They also prevent settling or clumping, reducing the polymer deposition on the compressor inert surfaces.

Metal deactivators control the catalytic effect which metal ions, especially copper, nickel, lead, iron, can have on the rate of hydrocarbon peroxidation.

There are three possible action mechanisms of metal deactivators suggested: chelation, surface passivation and bulk phase reactivity. Chelation is the ability of the additive to strongly complex the entire inner coordination sphere of the metal ion. Surface passivation leads to the reaction with the contact surfaces of the equipment, increasing their stability. Bulk phase reactivity is referred to any chemical activity other than chelation that changes the thermal stability of the stream and occurs in solution, where reaction with metal surfaces does not take place: e.g. homogeneous acid/base reactions such as neutralisation, chain-breaking peroxidation inhibition, hydroperoxide decomposition. Some of the metal deactivators can also be considered as corrosion inhibitors, when they are used a surface passivation agents. Common metal deactivators are amines, 0-chelate products, P-derivatives, such as N,N-disalicylidene-1,2-propanediamine.

The metal scavenger may be a compound which contains one or more functional groups containing one or more heteroatoms, N, O, S, P, or Se, which enables the compound to anchor onto the metal surface. Common metal scavengers are benzotriazole (BTA) and its derivatives, thiourea and its derivatives, in situ polymerization of heterocyclic compounds, such as pyrrole and thiophene and aniline, and chelates as 8-hydroxyquinolinemolecule and, pyrocatechols.

The pH control additive may be selected from a group comprising amines, ammonia and morpholine. Common products such as sodium carbonate, sodium hydroxide, carbon dioxide, organic acids, ethylene glycols and related compounds are also found. Buffers like sodium borate or sodium phosphate can also be used. The addition of pH control additives may be required for avoiding metal corrosion and metal catalyzed fouling.

It is also possible to combine any of the additives selected from a group comprising polymerization inhibitor, antioxidant, metal deactivator (or metal scavenger) corrosion inhibitor and pH-control additive. Thus, for instance it is possible to use a combination of antioxidants and polymerization inhibitor or a combination of metal scavenger and pH control additives or a combination of all additives.

In general the selection of the appropriate additive depends strongly on the process considered. For example, in case of heavy fouling processes or reactive components-containing streams, such as reactive olefins, diolefins, etc., or processes conducted at high temperatures polymerization inhibitors are preferably added to the wash oil. In processes which oxygen may be present or in the case of oxygenate components-containing streams the use of antioxidants or a combination antioxidants/polymerization inhibitors is preferred. Processes which are prone to corrosion (typically with water condensation units, unit at acid or at basic pH, etc) require preferably metal scavengers and/or pH control additives. Furthermore, if a process is carried out at high temperature, a combination of all above mentioned additives i.e. polymerization inhibitors, antioxidants, metal scavengers, pH control additives may be considered.

In a preferred embodiment the wash oil has the following composition: 2-5 mass % monoalkylbenzene, 80-95 mass % dialkylbenzene, 1.5-2 mass % trialkylbenzene, 2-5 mass % higher boiling point aromatics, 1.5-3 mass % Aryl-substituted aromatics, 0.05-3 mass % Antifoulants, antioxidants, metal scavengers and/or pH control additives.

In a particular preferred embodiment the mixture of the present wash oil comprises isopropylbenzene (Cumene), at least one diisopropylbenzene-isomer and at least one triisopropylbenzene-isomer.

In a most preferred embodiment, the wash oil comprises besides the isopropylbenzene all three diisopropylbenzene-isomers and all three triisopropylbenzene-isomers, i.e. a preferred variant of the wash oil comprises ortho-diisopropylbenzene, meta-diisopropylbenzene, para-diisopropylbenzene, 1,2,3-triisopropylbenzene, 1,2,4-triisopropylbenzene and 1,3,5-triisopropylbenzene.

In a most preferred embodiment the wash oil comprises 94-96 mass % diisopropylbenzene (DIPB); 2-4 mass % isopropylbenzene (Cumene), 1-2 mass % triisopropylbenzene (TRIPB) and 0.1-1.0 mass % heavier aromatic hydrocarbons. This composition of said wash oil corresponds essentially to a DIPB stream composition as an overhead product of a DIPB column. Said DIPB stream composition stems from an alkylation process of a reacting benzene with propylene to Cumene, wherein overalkylation to diisopropylbenzene may occur.

A Cumene process plant (US 2011/024558 A1) for producing Cumene from benzene and propylene consists typically of an alkylation reactor, a distillation section and a transalkylation reactor. The propylene feed and a mixture of fresh and recycled benzene are charged to the alkylation reactor, where the propylene reacts to completion to form mainly Cumene. Effluent from the alkylation reactor is sent to the depropanizer column, which removes the propane that entered the unit with a propylene feed along with any excess water which may have accompanied the feeds. The depropanizer column bottoms is sent to a benzene column where benzene is collected overhead and recycled back to the alkylation reactor. Benzene column bottoms is sent subsequently to the Cumene column where a Cumene product is recovered overhead. The bottoms from the Cumene column containing mostly diisopropylbenzene is sent to the DIPB column where DIPB is recovered and either sent to a transalkylation reactor or is used as wash oil as described above.

The overhead product of said DIPB column fulfils all criteria placed for a suitable wash oil and has the advantage that is readily available on side for use either directly as wash oil or as a blend with pyrolysis gasoline, for example 30-70% DIPB overhead and 70-30% pyrolysis gasoline. Said blends may also contain further additives, in particular antifoulants agents, such as polymerization inhibitors, antioxidants, dispersants, metal scavenger and/or pH control additives.

The DIPB stream obtainable as a side product of a Cumene production is fully aromatic, has a boiling point around 200° C. and the distillate contains no or very little solid and gums. Therefore, it fulfils the criteria for a suitable wash oil. The overhead DIPB can be mixed with further components such as other antifoulants antioxidants, metal scavenger and/or pH control additives.

An object of the present invention is also being solved by the use of a wash oil as described previously as anti-fouling agent in gas compressors, in particular in cracked gas compressors.

When using the described wash oil as an anti-fouling agent said wash oil is preferably injected continuously or non-continuously into the gas compressor. The injection of the wash oil into the gas compressor can take place at different rates and at different points. For instance, it is possible to inject the wash oil into the inlet of each separate stage or into each impeller separately. It is however mostly preferred to inject the wash oil to each impeller in order to assure that the wash oil reaches the latter impeller of a stage. If it is injected only into the section of a stage then it may evaporated completely or to such a great extend before reaching the latter impeller. When injecting the wash oil into the casing of a gas compressor the selection of the injection nozzle is important to ensure proper dispersion of the oil.

According to one embodiment the wash oil is injected with a continuous injection rate of 0.05 to 0.25 per stage as wt % of gas process. The injection rate depends thereby on the wash oil quality (i.e. aromatic content, boiling point). The higher the wash oil quality is, the lower the injection rate has to be.

As mentioned above it is also possible to inject the wash oil in a non-continuous matter that means intermittent or batch-wise. In this case the wash oil is injected at a high rate (i.e. five or more times the continuous rate in case of a continuous wash oil injection) for a specific period of time such as 30 to 60 min once a day. The higher rate assures that liquid reaches all the internal surfaces thereby increasing the effectiveness of the solvency.

BRIEF DESCRIPTION OF THE DRAWINGS

Further details of the invention will be explained in detail by the means of the following example with reference to the Figures. It shows.

DETAILED DESCRIPTION OF THE INVENTION

The overhead product of a DIPB column is used in the provided examples. Said DIPB overhead stream contains 94-96 mass % DIPB, 2-4 mass % Cumene, 1-2 mass % TRIPB and 0.1-1.0 mass % heavier aromatic hydrocarbons. The DIPB stream is obtained as a side product in the Cumene production from benzene and propylene.

Figure 1:
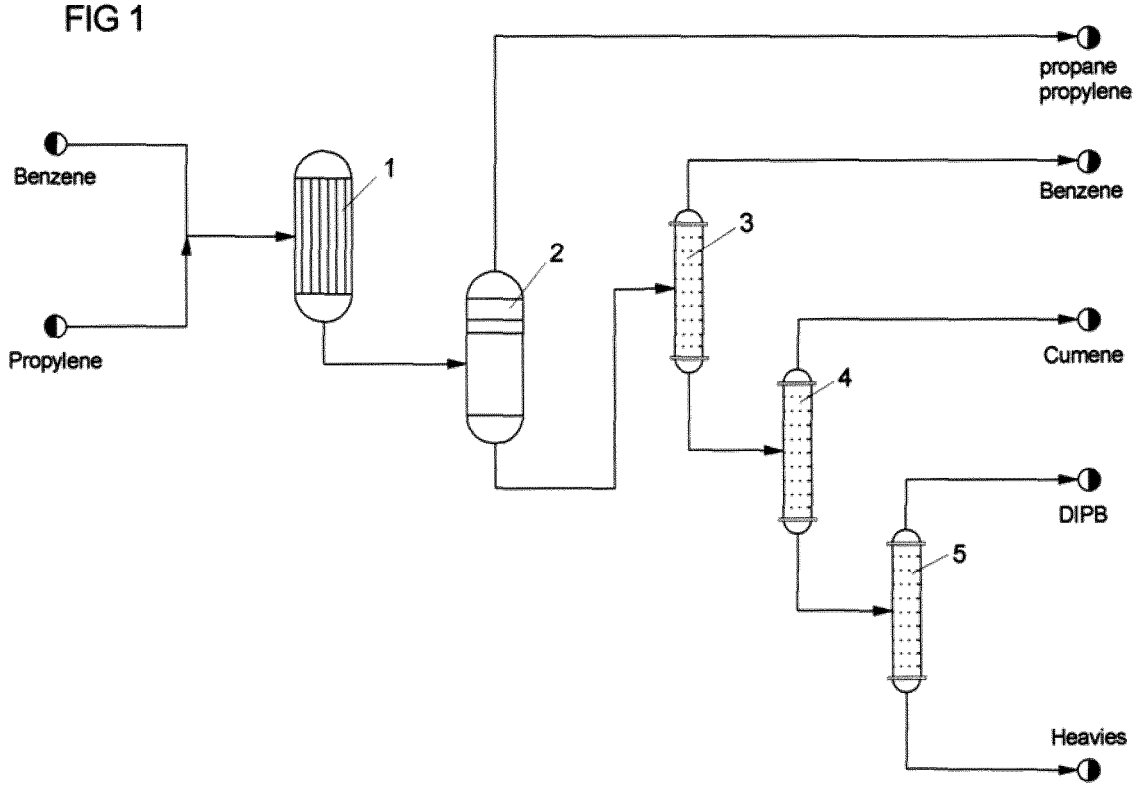
FIG. 1 a process flow diagram for cumene production.

A typical process flow diagram for Cumene production (US 2011/024558 A1) is shown in FIG. 1. Here, a propylene feed and benzene (either fresh or recycled) are charged to the alkylation reactor 1, where the propylene reacts to completion to form Cumene. The effluent from the alkylation reactor 1 is subsequently sent to the depropanizer column 2 for removing propane that entered the process plant with the propylene feed along with any excess of propylene and water. The bottom of the depropanizer column 2 is subsequently sent to a benzene column 3, where benzene is collected overhead. The benzene bottom in turn is sent to the Cumene column 4 where a Cumene product is recovered as an overhead and the Cumene bottom is sent to the DIPB column 5 where DIPB is also recovered as overhead and comprises the above-mentioned composition.

This DIPB overhead stream is subsequently used in the following tests and examples.

Figure 2:
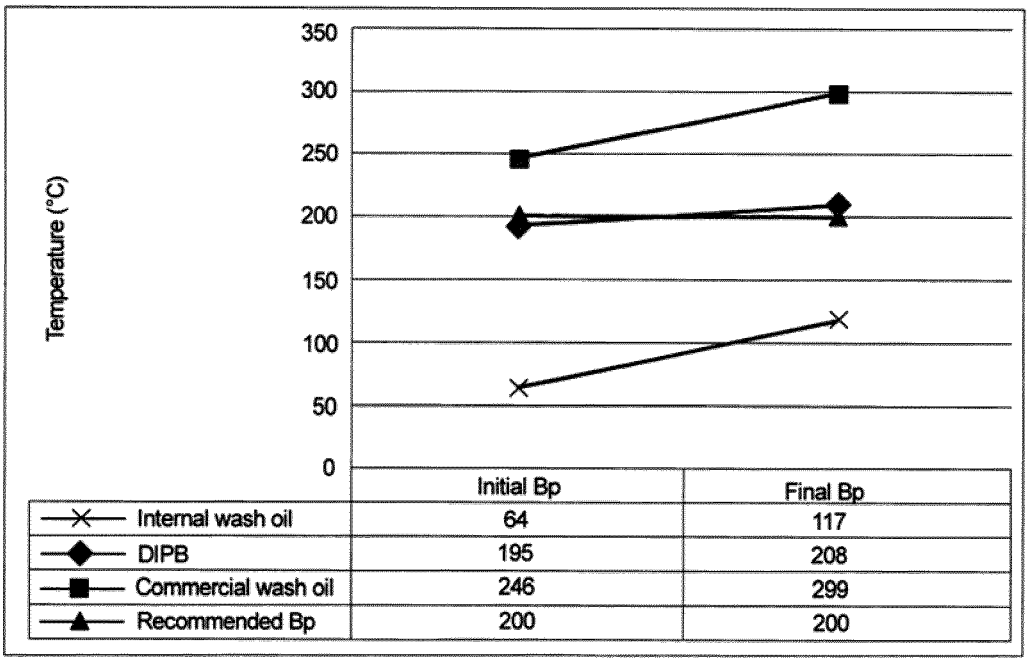
FIG. 2 a diagram showing boiling point of different wash oils.

In the diagram of FIG. 2 the boiling points of the DIPB overhead wash oil, a standard commercial wash oil and a third internal wash oil are compared to the recommended boiling point.

As can be seen from the diagram, the DIPB overhead stream has an initial boiling point of 195° C. and a final boiling point of 208° C. and fulfils the requirements of the recommended boiling points for wash oil which is for the initial boiling point and the final boiling point 200° C.

Figure 3:
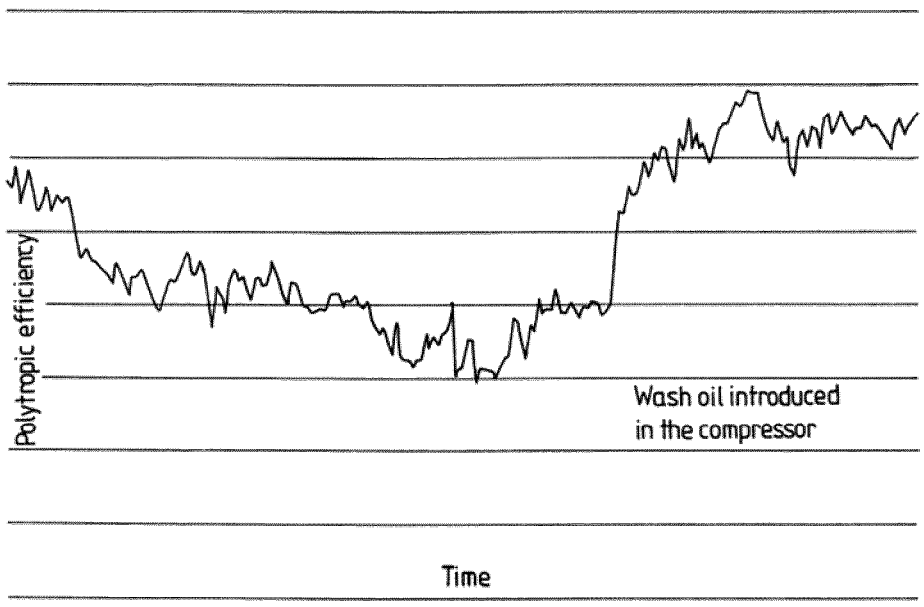
FIG. 3 a diagram showing the efficiency of a compressor depending on the introduction of wash oil, FIG. 4 a diagram showing solubility data of fouling samples using different wash oils, and FIG. 5A a diagram showing the compressor efficiency without addition of wash oil.

In the diagram of FIG. 3 the compressor relative polytrophic efficiency is plotted against time, before and after commercial wash oil is added. As clearly can be seen, the efficiency of the compressor deteriorates rapidly before the addition of the wash oil but is quickly recovered after wash oil is introduced in the system.

Figure 4:
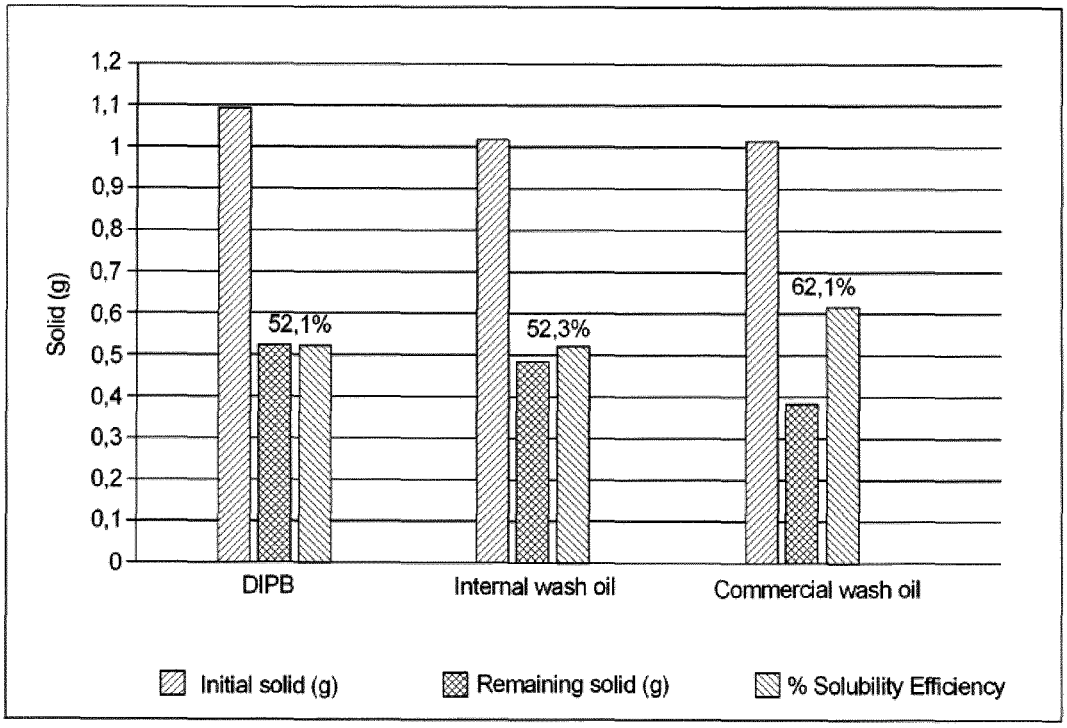

In the diagram of FIG. 4 experimental data are shown representing the solubility of fouling samples in DIPB wash oil as compared to the internal wash oil and commercial wash oil.

The solubility experiments were conducted using the following experimental procedure. In a first step, 10 ml of the wash solution DIPB, internal wash oil or commercial wash oil are heated in each case to a temperature of about 80° C. Subsequently, 1 g of the fouling residue from a compressor on a production side of the applicant is added to the 10 ml wash solution, which was pre-heated to 80° C. The mixture of wash solution and fouling residue is stirred for 20 min maintaining a constant temperature of 80° C. After that time period, the wash solution is filtered from the remaining solid and the remaining solid is dried in a vacuum oven for 20 min. The remaining and dried solid is then finally weighted and the value compared to the initial amount of about 1 g. The weight difference to the starting amount of the solid is then calculated as the solid solubilized in the wash solution.

The results of the solubility tests are summarized in the diagram of FIG. 4. All three wash solution tested show a good solubility efficiency of the fouling polymer sample used. The solubility efficiency of the DIPB wash oil was with 52.1% similar to the previously used internal wash oil and only slightly less than the commercial wash oil making it a good alternative to the presently available wash oils.

Figure 5A:
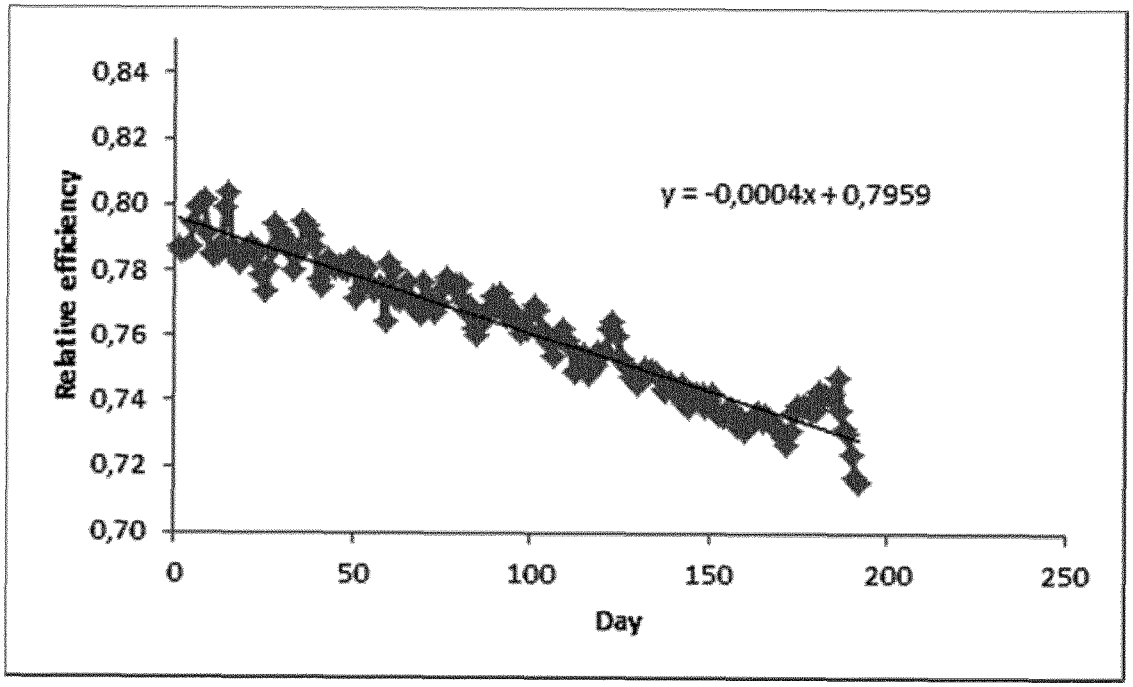
FIG. 5B a diagram showing the compressor efficiency in the presence of an antifoulant agent.
FIG. 5C a diagram showing the compressor efficiency in the presence of wash oil comprising aromatic compounds of formulae I, II and III.
FIG. 5D a diagram showing the compressor efficiency in the presence of wash oil comprising aromatic compounds of formulae I, II and III and antifoulant additives.

The effect of the wash oil without and with additives on the compressor efficiency is exemplarily shown in the diagrams of FIGS. 5A-D. The diagram of FIG. 5A depict the rather rapid decrease of the compressor efficiency over a time period of 200 days without the addition of any wash oil or antifouling agent.

Figure 5B:
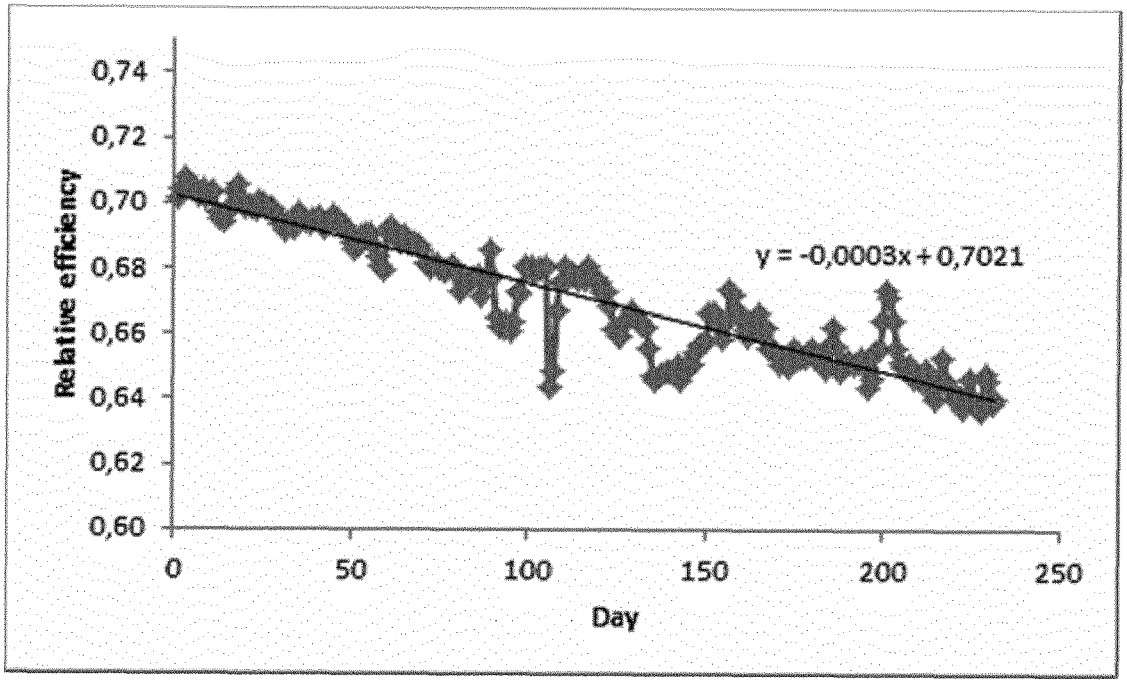

When adding only a polymerization inhibitor (e.g. 4-Hydroxy-2,2,6,6-tetramethylpiperidin-N-oxyl) as antifoulant agent the decline of compressor efficiency is slightly reduced (FIG. 5B).

When adding only a wash oil (here DIPB wash oil which is injected intermittently 3 hours per week) without any further additives or antifouling agents the decrease of compressor efficiency over a period of 200 days was reduced drastically (FIG. 5C) when compared to the data of FIG. 5A.

Figure 5C:
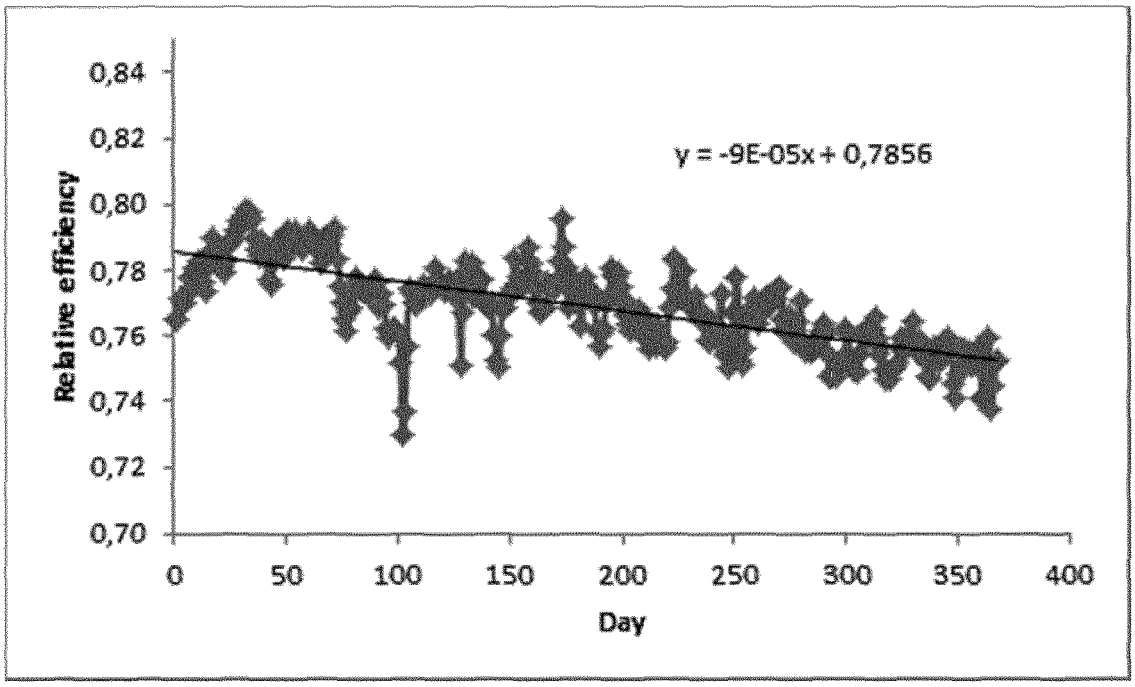
Figure 5D:
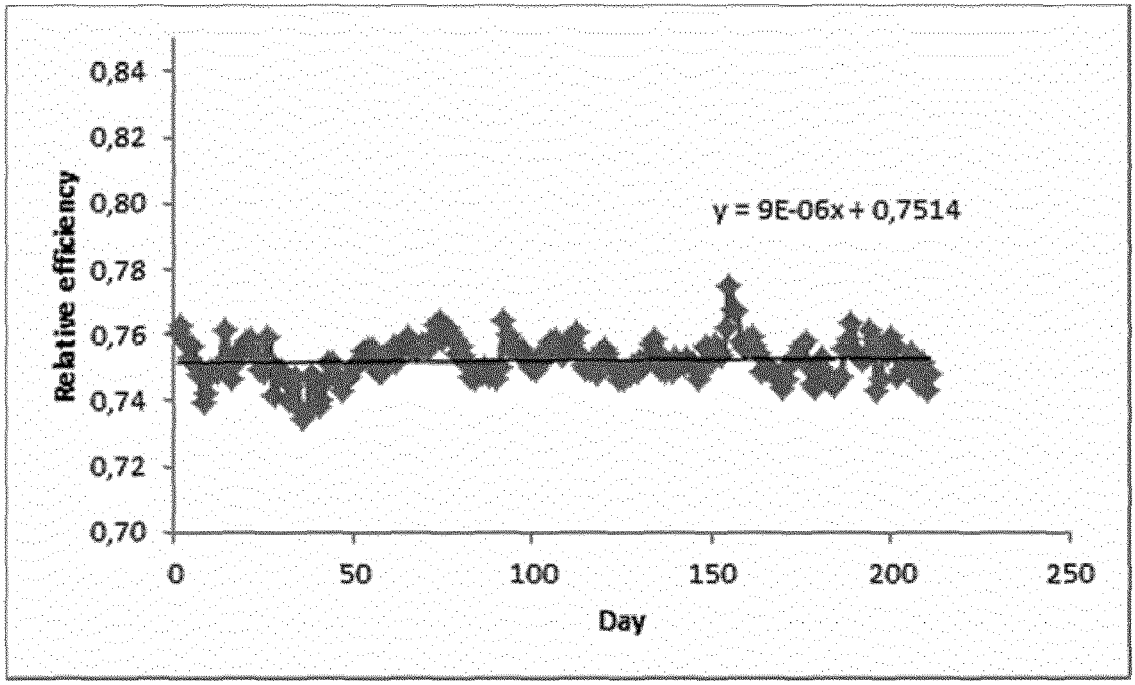

An even stronger effect on the compressor efficiency was detectable when the wash oil was combined with a polymerization inhibitor (e.g. 4-Hydroxy-2,2,6,6-tetramethylpiperidin-N-oxyl) in a ratio 1/100 inhibitor/wash oil. When adding the mixture of wash oil/inhibitor (which was injected intermittently 3 hours per week) no decline of the compressor efficiency over a period of 200 days was detectable (FIG. 5C).

In summary the combination of wash oil and inhibitor increased the compressor efficiency in a synergistic manner that was not predictable for a person skilled in the art. The synergistic effect may be due to specific interaction between wash oil and antifoulant agent as explained previously.

The invention claimed is:

1. An antifouling wash oil for gas compressors comprising:

a mixture comprising from 60% to 97% by mass of diisopropylbenzene, from 1% to 10% by mass of isopropylbenzene, and from greater than 0% to 5% by mass of triisopropylbenzene, wherein said amounts are based on the total mass of the wash oil, and at least one additive selected from the group consisting of polymerization inhibitor, antioxidant, metal deactivator, metal scavenger, corrosion inhibitor, pH-control additive and combinations thereof.

2. The antifouling wash oil according to claim 1, wherein the mixture comprises 94-96 mass % diisopropylbenzene; 2-4 mass % isopropylbenzene, 1-2 mass % triisopropylbenzene and 0.1-1.0 mass % heavier aromatic hydrocarbons.

3. The antifouling wash oil according to claim 1, having a boiling point between 150° C. and 300° C.

4. The antifouling wash oil according to claim 1, wherein the wash oil is free of non-aromatic compounds.

5. The antifouling wash oil according to claim 1, wherein the wash oil is mixed with other pyrolysis gas mixtures.

6. The antifouling wash oil according to claim 1, wherein the mass ratio of the mixture comprising diisopropylbenzene, isopropylbenzene, and triisopropylbenzene to at least one additive selected from the group consisting of polymerization inhibitor, antioxidant, metal deactivator, metal scavenger, corrosion inhibitor and pH-control additive is between 1000/1 and 10/1.

7. The antifouling wash oil according to claim 1, wherein the least one polymerization inhibitor is selected from the group consisting of aromatic and heteroaromatic compounds.

8. A process for applying an antifouling agent to a gas compressor comprising providing a wash oil according to claim 1.

9. The process according to claim 8, wherein the wash oil is injected continuously or non-continuously into the gas compressor.

10. The process according to claim 8, wherein the gas compressor is a cracked gas compressor.

11. The process according to claim 9, wherein the wash oil is injected with a continuous injection rate of 0.05 to 0.25 per stage as wt % of gas processed.

12. The antifouling wash oil according to claim 1, wherein the wash oil is free of non-aromatic compounds selected from at least one of C1-C8 alkanes, C2-C8 alkenes or C3-C8 alkynes.

13. The antifouling wash oil according to claim 3, having a boiling point between 190° and 220° C.

14. The antifouling wash oil according to claim 3, having a boiling point between 170° C. and 250° C.

15. The antifouling wash oil according to claim 1, wherein the antifouling wash oil is for use in cracked gas compressors.

16. The antifouling wash oil according to claim 6, wherein the mass ratio of the mixture comprising diisopropylbenzene, isopropylbenzene, and triisopropylbenzene to at least one additive selected from the group consisting of polymerization inhibitor, antioxidant, metal deactivator, metal scavenger, corrosion inhibitor and pH-control additive is between 500/1 and 50/1.

17. The antifouling wash oil according to claim 6, wherein the mass ratio of the mixture comprising diisopropylbenzene, isopropylbenzene, and triisopropylbenzene to at least one additive selected from the group consisting of polymerization inhibitor, antioxidant, metal deactivator, metal scavenger, corrosion inhibitor and pH-control additive is 100/1.

* * * * *